United States Patent [19]

Larson et al.

[11] 4,139,980

[45] Feb. 20, 1979

[54] AUTOMATIC FILM CONVEYING AND PACKING MECHANISM

[75] Inventors: Louis A. Larson, Minneapolis; Robert E. Diesch, Rogers, both of Minn.

[73] Assignee: PAKO Corporation, Minneapolis, Minn.

[21] Appl. No.: 786,183

[22] Filed: Apr. 11, 1977

[51] Int. Cl.[2] ..... B65B 63/00; B65B 5/10

[52] U.S. Cl. ..... 53/520; 53/564; 53/568; 53/244; 83/86; 271/272

[58] Field of Search ..... 53/123, 187, 244, 259, 53/266 A; 83/86, 155; 226/172; 271/189, 272, 273, 274

[56] References Cited

U.S. PATENT DOCUMENTS

| | | | |
|---|---|---|---|
| 667,604 | 2/1901 | Stockholm | 271/198 |
| 1,882,403 | 10/1932 | Maxson | 83/86 |
| 1,886,119 | 11/1932 | Price | 53/187 |
| 3,128,660 | 4/1964 | Gaubert | 83/155 |
| 3,239,214 | 3/1966 | Rauschenberger | 271/273 |
| 3,932,982 | 1/1976 | Klapp | 53/259 X |

*Primary Examiner*—Robert Louis Spruill

*Attorney, Agent, or Firm*—Kinney, Lange, Westman and Fairbairn

[57] ABSTRACT

An automatic film conveying and packaging mechanism for conveying cut film lengths forwardly from a film cutter to a packaging envelope while maintaining continuous contact with the film lengths between a pair of opposed upper and lower conveyor assemblies and driving the lengths directly into the packaging envelope in stacked relation to each other with the trailing ends thereof positively disposed in substantial alignment with each other and in rearwardly spaced relation to the discharge end of the upper conveyor assembly.

7 Claims, 3 Drawing Figures

AUTOMATIC FILM CONVEYING AND PACKING MECHANISM

BACKGROUND OF THE INVENTION

The least automated area of the photographic industry has been the packaging of individual customer orders of prints and film. Many difficulties are associated especially with the automatic packaging of developed films. Conventional film is relatively flimsy, which makes it difficult to handle and convey to a desired location. Static electricity generated by the handling of the film makes it very difficult to transport in the same manner as prints, since the static electricity tends to make the film cling to the film conveying surfaces. Film may be curled upwardly or downwardly along either its longitudinal or transverse axis, making it difficult to transport without jamming, which has been a problem associated with prior art mechanisms. Finally, it has been a very difficult problem to deliver cut film lengths into a packaging envelope, due to the above mentioned difficulties.

U.S. Pat. No. 3,789,571 granted Feb. 5, 1974 to Leonard Tall et al, entitled PROCESSOR'S PHOTOGRAPHIC PRINT SORTING AND PACKAGINE MACHINE AND METHOD discloses an apparatus to convey and load prints and cut film into collection trays or compartments, including means (not described in said patent) to convey the cut film from a film cutter into a compartment or tray which is then dumped into the desired pocket of a carrying and segregating assembly (referred to in the Tall et al patent as a carrier stock). The carrier stock is subsequently hand inserted into a packaging envelope after the film, prints, and other materials have been dumped therein. When the tray is dumped the film falls down into the carrier stock section or pocket under the force of gravity and whatever momentum (if any) which may be acquired during the dumping action. This is an inefficient device and provides so means for maintaining positive driving contact with the cut film lengths during the transporting and depositing thereof into the carrier stock or assembly for subsequent manual insertion into a packaging customer order envelope.

SUMMARY OF THE INVENTION

The present invention provides a mechanism for positively and continuously power driving the individual cut lengths of film discharged from a film cutter mechanism, directly into a packaging envelope. The mechanism includes an upper and lower conveyor assembly positioned in adjoining generally overlapping parallel relation to each other with the receiving end of the lower assembly more proximately disposed to the film cutter than the receiving end of the upper assembly to support the film lengths before insertion between the assemblies, but with an intermediate portion and the discharge end of the upper assembly overhanging the discharge end of the lower assembly.

The preferred embodiments of the present invention include means to overcome the clinging of the film lengths to each other and to the film conveyor assemblies caused by static electricity. The means includes rigid elements, or fingers, positioned in close relation to the overhanging portion of the upper assembly to support, in driving contact with the overhanging portion, the portion of the film length not in contact with the lower assembly. The means also includes a deflecting plate positioned in generally declined closely spaced relation to the discharge end of the upper assembly to impart a downwardly directed force on the length of film contacting it and thereby affirmatively snapping the film length downwardly and away from the discharge ends of both conveyor assemblies and into the packaging envelope when the length is driven out of contact with the fixed control elements, to neatly stack the film lengths with all trailing edges substantially aligned with each other and disposed slightly behind the overhanging discharge end of the upper conveyor and the underlying fixed control elements.

DETAILED DESCRIPTION OF THE PREFERRED EMBODIMENTS

Figure 1:
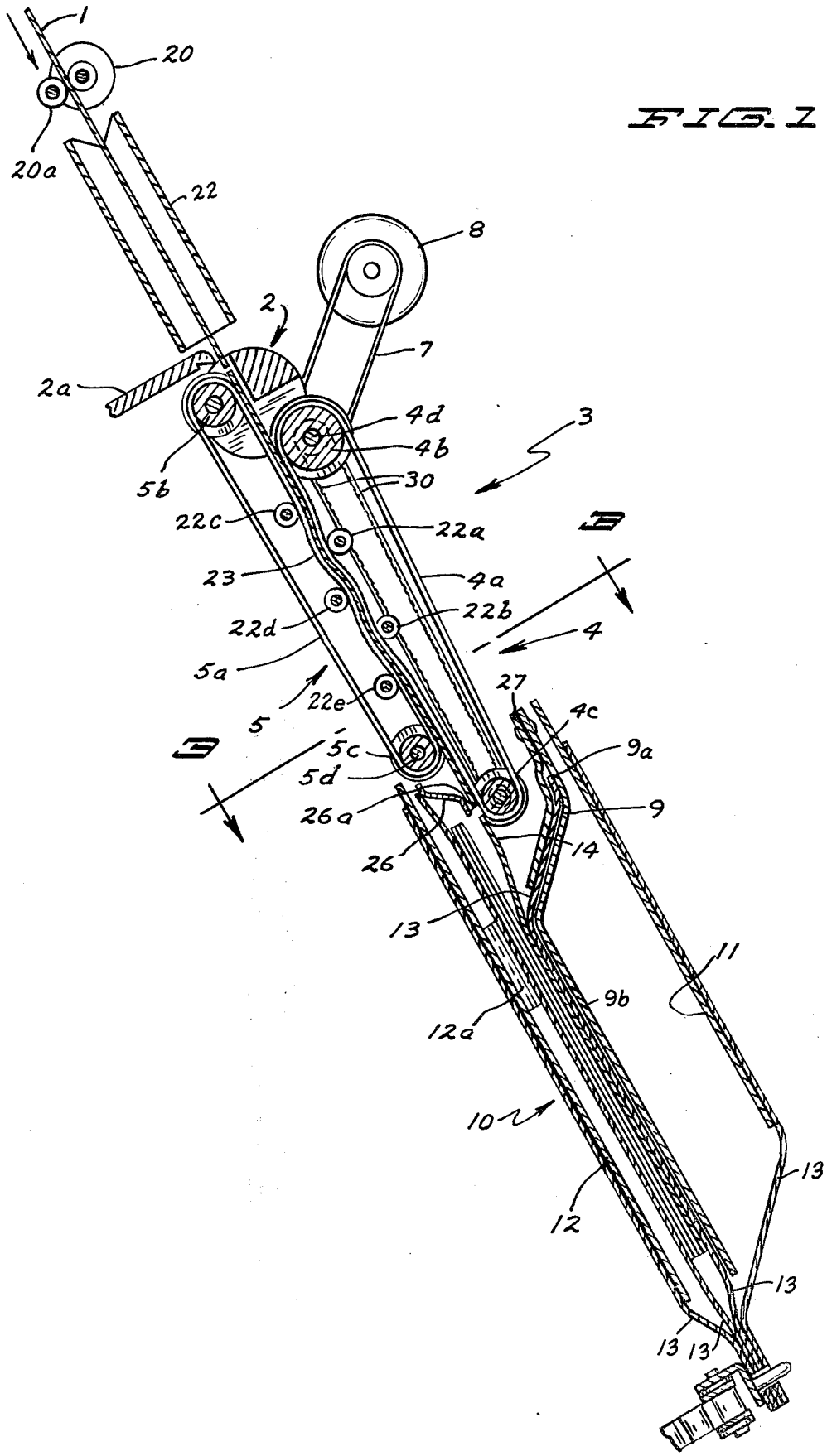
FIG. 1 is a longitudinal vertical sectional view of the film conveying and packing mechanism.

In FIG. 1, a strip of film 1, from a roll (not shown) containing a large number of individual customer orders spliced together, is advanced by a first driving means, such as stepping motor 20 and roller 20*a* positioned in the manner shown, through a film cutter 2, such as the Multi-purpose Film Cutter manufactured by Pako Corporation, Minn., and described in U.S. Pat. No. 4,056,026 and into contact with the receiving end of a film conveying mechanism 3 which is positioned in close relation to the discharge end of said cutter 2. Film conveying mechanism 3 comprises, in the form shown, upper and lower conveyor belt assemblies 4 and 5 which are disposed in adjoining generally overlapping parallel relation to each other and defines a cut film length feed path 23 between the two assemblies 4 and 5. The strip receiving end of lower belt assembly 5 is disposed closer to the film cutter 2 than the strip receiving end of upper belt assembly 4. Upper and lower belt assemblies 4 and 5 respectively each comprise a pair of soft, flexible, compressible high friction belts 4*a* and 5*a* trained about two pairs of pulleys 4*b* and 4*c* and 5*b* and 5*c*, the respective pairs of belts 4*a* and 5*a* being transversely spaced apart (as shown FIG. 2) so that only the longitudinal edges of each film strip 1 will be contacted by belts 4*a* and 5*a*. The lower runs of the belts 4*a* of the upper conveyor assembly normally contact the respective upper runs of opposed corresponding belts 5*a* of the lower conveyor assembly 5. Pulley 4*b* is connected to a second driving means such as a conveyor stepping motor 8. A plurality of offset idler rollers 22*a*–22*e* are positioned in contact with belts 5*a* and 4*a* forming a serpentine feed path 23 to maintain good frictional driving contact between belts 5*a* and 4*a* and the prints being transported thereby. Rigid fingers 26 are positioned in close spaced relation to the overhanging portions of the lower runs of belts 4, the ends of fingers 26 coming to a point as shown in FIG. 1. The distance between the belts 4*a* and the ends of fingers 26 is slightly less than the thickness of the strip 1.

Figure 2:
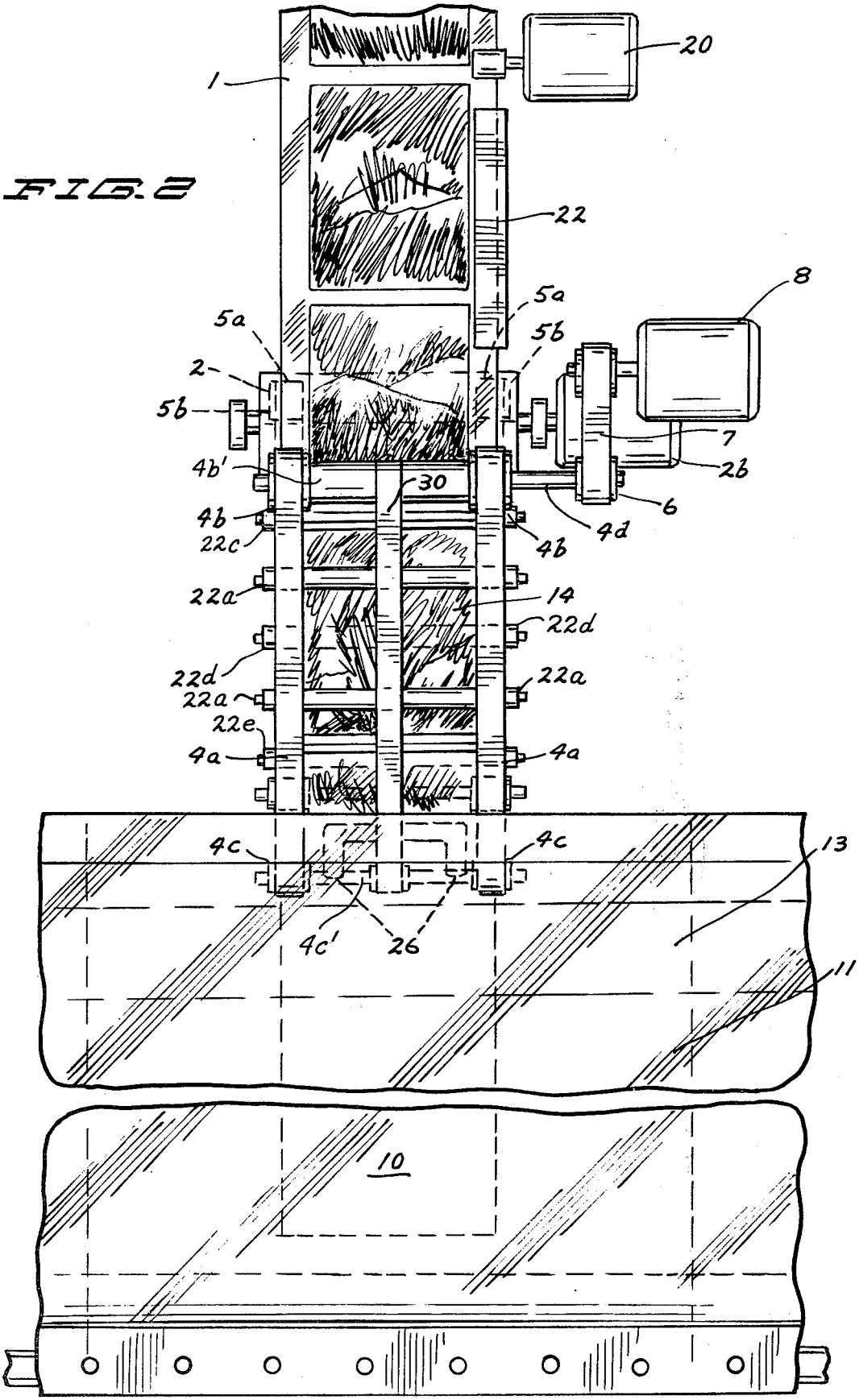
FIG. 2 is a top plan view of said mechanism.
Figure 3:
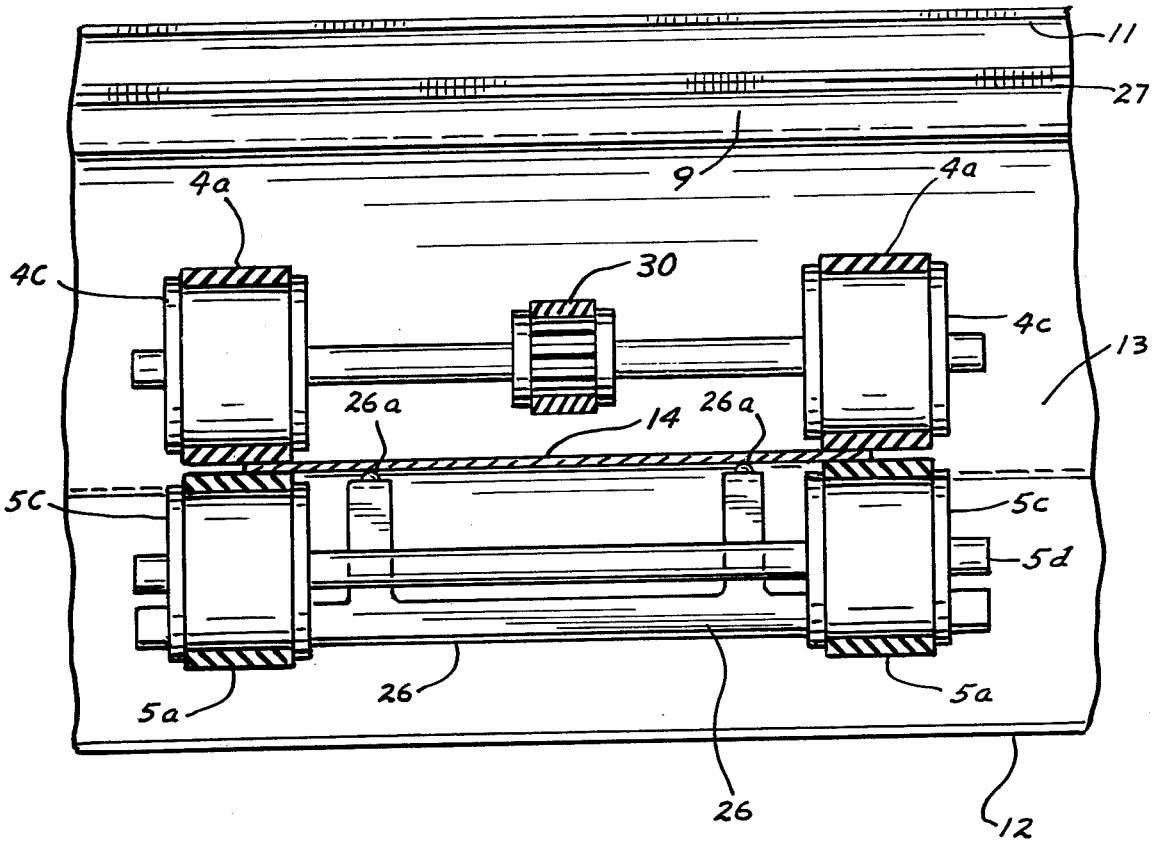
FIG. 3 is a transverse vertical section taken substantially along the lines 3—3 of FIG. 1.

As shown in FIGS. 1–3, a timing belt 30 is trained over shaft 4*b*′ of pulley 4*b* and shaft 4*c*′ of pulley 4*c*. Timing belt 30 engages timing gears on shafts 4*b*′ and 4*c*′ to overcome the tendency of the conveyor belts 4*a* to "creep" during operation.

Film packing station 10 includes envelope receiving elements 9*b*, 11, and 12 spaced apart in parallel relation, spring 12*a*, and an end support slot formed by elements 9*a* and 27. A multilayer envelope 13 is supported by the various elements. The cut lengths of film are deposited between two layers of envelope 13 which are positioned between envelope receiving elements 9*b* and 11. Spring means 12*a* lightly urges the trailing ends of the deposited lengths against upper element 9*b* to keep the trailing ends in positive alignment with each other.

In typical operation, stepping motor 20 advances a predetermined number of film frames contained in strip 1 through cutter 2 and into film feed path 23. The lower belts 5*a* provide support for the leading edge of strip 1 after it is passed through cutter 2 and before the leading edge is inserted into the film feed path 23. The pair of rollers 4*b* are of larger diameter than rollers 4*c* to prevent the leading edge of strip 1 from curling up and climbing over the rollers 4*b*, and thereby jamming the film conveying mechanism 3. Since idler rollers 22*a*–22*e* force the pair of belts 4*a* to be normally in frictional driving contact with the pair of belts 5*a*, strip 1 must slightly compress both pairs of belts 4*a* and 5*a* in order to be positioned between them in the feed path. This ensures good driving engagement of the strip 1 and belts 4*a* by belts 5*a*. When the predetermined number of individual frames, which comprises a film length 14, have been driven through film cutter 2, stepping motor 20 is de-energized and film length 14 is cut from strip 1 by cutter 2. Conveyor stepping motor 8 is also deenergized during the cutting operation, but is immediately thereafter energized and advances film length 14 a predetermined distance along feed path 23. Both stepping motors 20 and 8 are then energized to simultaneously drive a new portion of film strip 1 through cutter 2 and along feed path 23, and to positively drive film length 14 against the deflecting plate 9 and into an envelope 13 positioned in close relation to the discharge end of mechanism 3 respectively. The advancing of film length 14 is necessary to correct any error between the distance and velocity that strip 1 is moved by stepping motor 20 and the distance and velocity that film length 14 is moved by stepping motor 8 which, if uncorrected, might result in the overlapping of film length 14 by strip 1 and the subsequent misfeeding of film length 14 into envelope 13.

Fingers 26 support in driving contact with the overhanging portion of upper assembly 4 the segment of length 14 not in contact with the lower assembly 4. Fingers 26 are so aligned with assembly 4 that only the ends of fingers 26 come into contact with film length 14 so as to minimize the possibility of film length 14 hanging up on fingers 26 and jamming the mechanism 3.

Deflecting element 9 imparts a generally downwardly directed force on film length 14 contacting element 11, which causes film length 14 to affirmatively snap downwardly when the trailing end is driven out of contact with the ends of the fingers 26, providing a clean breakaway from belts 4*a* and 5*a* and fingers 26. Film length 14 is thus positively deposited into envelope 13 and onto previously deposited lengths 14, with the trailing end of length 14 aligned with the trailing ends of previously deposited lengths 14 in neatly stacked rearwardly spaced relation to the discharge end of mechanism 3.

It can be seen that the present invention provides a simple and highly efficient automatic apparatus for positively conveying lengths of film from a film cutter and for positively driving said lengths into an envelope positioned to receive the lengths in stacked relation, the trailing ends of the lengths positively positioned in aligned relation to each other and rearwardly of the discharge end of the film conveying mechanism.

In one preferred embodiment, the mechanism of the present invention is used in a photographic system in which prints are automatically cut, sorted, and packed in a customer order package and in which film is automatically cut into film lengths and packed in the customer order package with their corresponding prints. Further description of this system may be found in the co-pending applications entitled AUTOMATIC PRINT SORTING, CONVEYING AND PACKAGING MECHANISM Ser. No. 786,184 and AUTOMATIC PHOTOGRAPHIC PRINT AND FILM PACKAGING MECHANISM Ser. No. 786,182 which are assigned to the assignee of the present application.

It will be understood, of course, that various changes may be made in the form, details, arrangement and proportions of the parts without departing from the scope of this invention as set forth in the appended claims.

What is claimed is:

1. A mechanism for conveying non-overlapping cut photographic film lengths from a film cutter and for inserting the cut film lengths into a packaging envelope, the mechanism comprising:

upper and lower conveyor belt assemblies positioned in adjoining generally overlapping parallel relation to each other, the conveyor belt assemblies being positioned to receive therebetween cut film lengths from the film cutter, the upper conveyor belt assembly having a discharge end extending into a mouth of the packaging envelope, wherein an intermediate portion and the discharge end of the upper assembly overhang the discharge end of the lower assembly;

finger elements positioned in close rearward relation to the discharge end of the lower assembly and below the overhanging intermediate portion of the upper assembly portion to support in driving contact with the overhanging intermediate portion of the upper assembly the portion of the cut film length unsupported by the lower assembly; and means for driving the conveyor belt assemblies to transport the cut film lengths from the film cutter to the packaging envelope, whereby the individual cut film lengths are power driven into the packaging envelope in overlying stacked relation to each other with the trailing ends thereof disposed in substantial alignment and in rearwardly spaced relation to the discharge end of the upper conveyor belt assembly.

2. The mechanism set forth in claim 1 wherein the upper and lower conveyor belt assemblies respectively comprise:

a plurality of belts made from soft compressible high friction material each trained about a pair of opposed pulleys, each belt of the upper assembly positioned above and in contact with one belt of the lower assembly.

3. The mechanism set forth in claim 2 wherein the lower assembly has its receiving end more proximately disposed toward the discharge end of said film cutter than the receiving end of the upper assembly to guide the film lengths between the upper and lower assemblies.

4. The mechanism set forth in claim 2 wherein upper and lower conveyor belt assemblies further comprise:

belt tensioning means positioned against upper and lower runs of the belts of the lower and upper assemblies, respectively forming a transverse bend in said runs to maintain positive driving contact between the upper and lower runs.

5. The mechanism set forth in claim 2 and further comprising:

timing belt means trained about shafts supporting the pair of opposed pulleys of the upper conveyor belt assembly.

6. The mechanism set forth in claim 1 and further comprising a deflecting plate positioned in close generally inclined relation to the discharge end of the upper assembly and in close relation to the mouth of the packaging envelope to force the leading end of the cut film length being transported by the upper and lower assemblies downwardly and into the packaging envelope, the deflecting plate causing a transverse bend in the cut film length which bend causes the trailing end of the cut film length to affirmatively snap downwardly after it is driven out of contact with the finger elements, thereby stacking the cut film length in overlapping manner on previously transported cut film lengths with the trailing ends of the previously transported cut film disposed in substantial alignment with each other and in rearwardly spaced relation to the discharge end of the upper conveyor belt assembly.

7. The mechanism set forth in claim 5 and further comprising:

a pair of envelope receiving elements spaced slightly apart in parallel relation and positioned in close rearward relation to the discharge end of the upper conveyor belt assembly, the receiving elements exerting pressure upon the cut film lengths deposited therebetween and into said envelope; and spring means for lightly urging the trailing ends of the deposited lengths against the upper element to keep the trailing ends in positive alignment with each other.

* * * * *